United States Patent [19]

Okamoto et al.

[11] 4,095,884

[45] Jun. 20, 1978

[54] EXPOSURE CONTROLLING APPARATUS FOR ELECTROPHOTOGRAPHIC COPYING MACHINE

[75] Inventors: Toyoo Okamoto, Yokohama; Kenji Kojima, Tokyo, both of Japan

[73] Assignee: Ricoh Company, Ltd., Tokyo, Japan

[21] Appl. No.: 717,890

[22] Filed: Aug. 25, 1976

[30] Foreign Application Priority Data

Aug. 29, 1975 Japan ..... 50-105527

[51] Int. Cl.[2] ..... G03G 15/04

[52] U.S. Cl. ..... 355/3 R; 355/36; 355/71

[58] Field of Search ..... 355/3 R, 14, 35, 36, 355/71

[56] References Cited

U.S. PATENT DOCUMENTS

| | | | |
|---|---|---|---|
| 3,731,611 | 5/1973 | Aasen et al. | 355/71 UX |
| 3,771,867 | 11/1973 | Moser | 355/3 R |
| 4,003,652 | 1/1977 | Allen et al. | 355/71 |

*Primary Examiner*—A. D. Pellinen

*Attorney, Agent, or Firm*—Cooper, Dunham, Clark, Griffin & Moran

[57] ABSTRACT

An exposure controlling apparatus for electrophotographic copying machines comprises an operating member which is operable externally of the machine to control the amount of exposure. The operating member is normally biased to return to its neutral position, but can be temporarily held in its operative position when operated. The temporary retention is released upon completion of a copying operation, allowing the operating member to return to its neutral position.

7 Claims, 7 Drawing Figures

FIG. 4
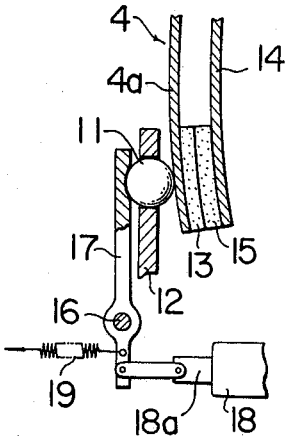
FIG. 5
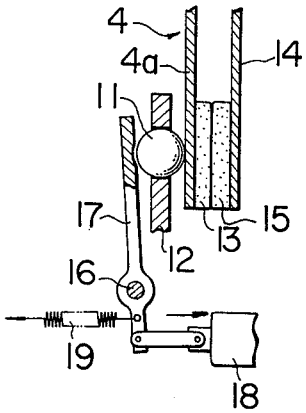
FIG. 6
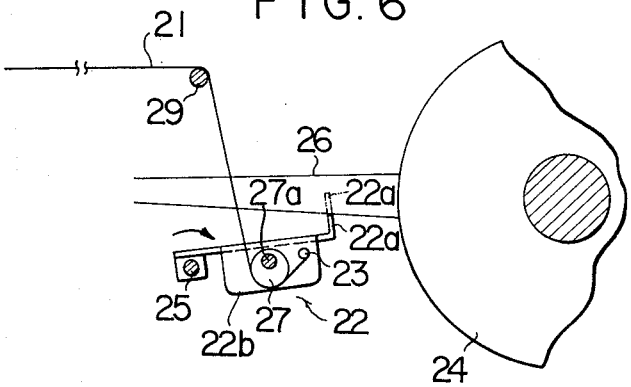
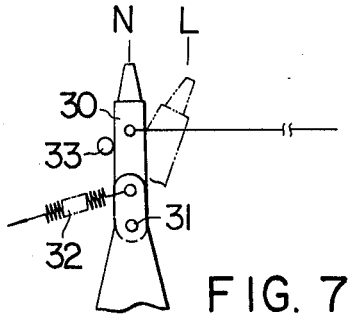
FIG. 7

EXPOSURE CONTROLLING APPARATUS FOR ELECTROPHOTOGRAPHIC COPYING MACHINE

BACKGROUND OF THE INVENTION

The invention relates to an exposure controlling apparatus for an electrophotographic copying machine, and more particularly, to such apparatus in which the exposure value, once adjusted by an operator for a particular copying operation, is automatically reset to a normal value upon completion of that copying operation.

One of the factors in obtaining a sharp and clean copy image in an electrophotographic copying machine is the application of a proper exposure to a photosensitive member which has its surface uniformly charged as by corona discharge. An overexposure results in an apparently fair copy free from background smearing (the attachment of toner to non-image areas of the copy) when the electrostatic latent image formed on the surface of the photosensitive member is subsequently developed by a developer which contains toner. However, the density in the image areas diminishes also, with possible consequences that thin lines are not developed in a satisfactory manner or a copy of required legibility is not obtained from an original containing letters and characters of a reduced optical density. Conversely, an underexposure produces a background smearing on the resulting copy. As a result presently available electrophotographic copying machines include some form of sophisticated means which dispenses with the need for close exposure control to assure that a sharp and clean copy is produced from most originals when a copying operation is performed with a given exposure. The use of a developing electrode which is applied with a bias voltage in the developing unit is one example.

However, sophistication in the developing unit cannot assure the reproduction of a sharp and clean copy from every kind of those including originals having an extremely high or low contrast between the image and the non-image area, originals having a blackish or a white background, or the like. It follows therefore that an adjustment of the exposure is still necessary with certain originals. However, it is to be noted that such an exposure control is necessary only with special originals such as those having a colored background, for example, which are infrequently used, and it is desirable that the exposure value be maintained at a predetermined value except when these special originals are used. When an operator produces a copy from a special original by making a corresponding exposure control adjustment and leaves the copying machine under the adjusted condition, another operator may want to use the machine to obtain a copy from an ordinary original. If the second operator operates the machine in the usual manner without noticing the exposure control adjustment made by the preceding operator, a satisfactory copy may not be obtained, since an ordinary original should be copied under the normal or preset exposure condition.

Therefore, it is desirable that an exposure value, once adjusted by an operator for a particular copying operation, be automatically reset to a normal value or a predetermined constant value upon completion of that copying operation.

SUMMARY OF THE INVENTION

It is an object of the present invention to provide an exposure controlling apparatus for an electrophotographic copying machine whereby when an exposure value, is adjusted by an operator for a particular copying operation, the exposure will be automatically reset to a normal value upon completion of that copying operation.

It is another object of the invention to provide an exposure controlling apparatus in which when an exposure value other than the normal value is set for a particular copying operation, the exposure is maintained at the set value during the duration of that copying operation.

BRIEF DESCRIPTION OF THE DRAWINGS

FIG. 4 is a cross section similar to FIG. 3 but showing the operating member moved from its neutral position to an adjusted exposure position;

FIG. 5 is a similar view showing the condition when the solenoid is energized;

FIG. 6 is a side elevation of an exposure control member adapted to move into or out of an exposure flux which irradiates a photosensitive member; and FIG. 7 is a front view of a portion of a modified embodiment of the invention.

DESCRIPTION OF THE PREFERRED EMBODIMENTS

Figure 1:
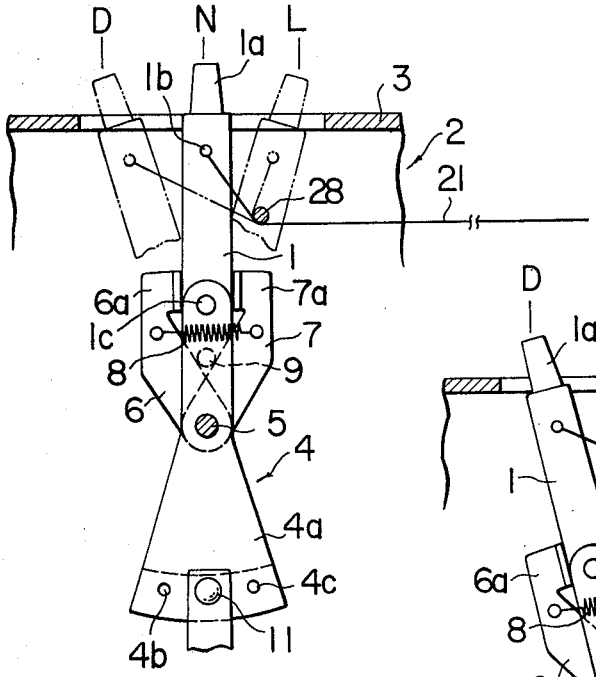
FIG. 1 is a front view of the exposure controlling apparatus constructed in accordance with one embodiment of the invention.

Referring to FIG. 1, an exposure controlling, operating member 1 has a knob 1*a* on one end which projects externally of a top cover 3 of a copying machine 2. A resilient blade 4 having a downwardly extending fan-shaped extension 4*a* is riveted at 1*c* to the lower end of the operating member 1. The operating member 1 and the blade 4 are both pivotally mounted on a common pin 5 which is secured to a stationary part of the machine, whereby the operating member 1 is rockable or movable between a first or neutral position indicated by a reference character N and a second and a third position, indicated by reference characters D and L, respectively. A pair of return levers 6, 7 each have one end also pivotally mounted on the pin 5, and have their free ends 6*a*, 7*a* held in abutting relationship with the opposite sides of the operating member 1 under the resilience of a tension spring 8 which has its opposite ends anchored to the respective levers.

Figure 3:
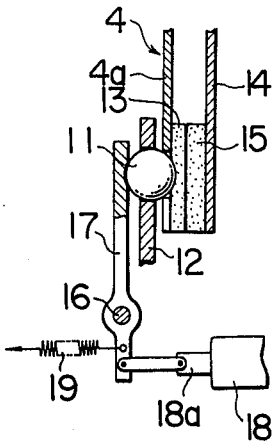
FIG. 3 is a cross section taken along the line III—III shown in FIG. 2, additionally showing a pressure member and a solenoid both not shown in FIG. 2.

At their lower ends, the return levers 6, 7 intersect with each other, and a stop pin 9 is fixedly mounted on the stationary part mentioned above adjacent to the region of such intersection. It will be noted from FIG. 1 that the inner lateral side of both return levers 6, 7 bears against the pin 9 in the neutral position N of the operating member 1. Along its lower periphery, the extension 4*a* of the reslient blade 4 is formed with a pair of holes 4*b*, 4*c* which are selectively engaged by a click-stop ball 11 as the operating member 1 is rocked in either direction. FIG. 3 shows the manner in which the ball 11 operates to retain the operating member 1 in either the second or third position D, L to which it is rocked. Specifically, the ball 11 is loosely received in an opening formed in a stationary plate 12, and partly engages the hole 4*b* or 4*c* on one side. On it back side, the extension 4*a* has a frictional member 13 such as a rubber sheet secured thereto, which is engaged by another frictional member 15 of similar material which is secured to a stationary resilient backup plate 14.

With continued reference to FIG. 3, there is provided a stationary pin 16 on which is pivotally mounted a pressure member 17 having one end connected with a plunger 18*a* of a solenoid 18 and also engaged with one end of a tension spring 19, the other end of which is secured to a stationary point. The other end of the pressure member 17 is held against the ball 11 under the resilience of the spring 19 unless the solenoid 18 is energized.

Referring to FIG. 1, the operating member 1 fixedly carries a pin 1*b* thereon, to which one end of a wire 21 is anchored, the other end of the wire being secured to a pin 23 on an exposure control member 22 located in the proximity of a photosensitive member 24 as shown in FIG. 6. Referring to FIG. 6, the control member 22 is pivotally mounted at its one end by a pin 25, so as to permit its rocking motion. The free end of the control member 22 is formed with a light shield 22*a* which is bent to extend toward the path 26 of exposure flux. By a spring, not shown, the control member 22 is biased to rotate clockwise about the pin 25 or in a direction away from the flux 26. The wire 21 extends from the pin 1*b* on the operating member around stationary pins 28, 29 and around a cam 27 to the pin 23 on the control member 22, as illustrated in FIGS. 1 and 6. The cam 27 is eccentrically secured by a setscrew 27*a* on a downwardly depending wall 22*b* of the control member 22 and serves to permit adjustment of the starting and the terminal position of the rocking motion.

Figure 2:
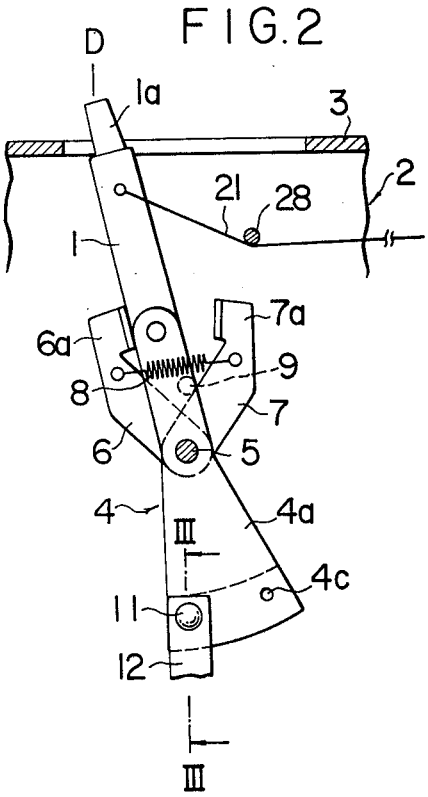
FIG. 2 is a similar view to FIG. 1, but showing an exposure controlling, operating member displaced so as to establish an adjusted exposure value.

In operation, when the operating member 1 is turned to the left, as viewed in FIG. 1, about the pin 5 to bring it into the second position D, the ball 11 engages the hole 4*b* in the resilient blade 4, whereby the operating member 1 is click stopped in this position. During such a rocking motion of the operating member 1, the spring 19 urges, by its resilience, the pressure member 17 against the ball 11, so that the resilient blade 4 flexes resiliently to bring the frictional member 13 thereon into abutting relationship with the other frictional member 15 on the backup plate 14 until the operating member 1 reaches the second position D, whereupon it is click stopped as illustrated in FIG. 3. During such angular movement of the operating member 1, the return lever 6 is driven by it to turn to the left about the pin 5 against the resilience of the spring 8 while the other return lever 7 remains immovable by bearing against the stop pin 9 (see FIG. 2). The magnitude of frictional drag acting between the members 13 and 15 is sufficient to overcome the resilient force exerted by the spring 8 which is thus extended to prevent the operating member 1 from being driven back to the first or netural position N.

It will be thus seen that the operating member 1 can be frictionally locked at any position intermediate the neutral position N and the second position D. When the operating member 1 is rocked to the position D, the movement imparted to the wire 21 will be at maximum, and the control member 22 is turned counterclockwise about the pin 25 to advance its light shield 22*a* into the path of irradiating or exposure light 26, thus producing a minimum exposure of the photosensitive member 24. By interrupting the angular movement of the operating member 1 at a selected position intermediate the positions N and D, the advance of the shield 22*a* into the light path 26 may be controlled to a desired degree.

When the operating member 1 is turned in a direction from the position N toward the position L or in a direction to allow the movement of the wire 21 by a pull exerted by the spring (not shown) which biases the control member 21 clockwise, the shield 22*a* will be retracted from its neutral position, thereby providing an increased exposure of the photosensitive member 24. Again the degree of increased exposure can be controlled by choosing a suitable position intermediate the positions N and L at which the operating member 1 is locked.

It will be seen that the angular movement of the operating member 1 takes place by forcedly turning the knob 1*a* overcoming the resistance of frictional drag acting between the members 13, 15. On the other hand, as the operating member 1 is moved from the position D to the neutral position N, the return lever 6 turns clockwise under the resilience of the spring 8 until it bears against the stop pin 9. When the operating member 1 is moved from the position N to the position L, the return lever 7 is turned clockwise about the pin 5 against the resilience of the spring 8.

The solenoid 18 is adapted to be energized at such a time as the completion of a copying operation or the turning off of a main or master switch occurs in the copying machine. As it is energized, the pressure member 17 is pulled by the plunger 18*a* to pivot counterclockwise about the pin 16, as shown in FIG. 5. When this happens, the ball 11 which has been forced into the resilient blade 4 is released and the blade is allowed to recover slightly, whereupon the frictional drag acting between the members 13 and 15 reduces rapidly, allowing the operating member 1 to be returned to the neutral position N from a position shown in FIG. 2, for example, by the resilience of the spring 8 which is transmitted thereto through the corresponding return lever which is now return lever 6. Such an automatic resetting or return takes place from any position between and including the opposite extreme positions D and L. The cam 27 shown in FIG. 6 may be moved angularly to effect a fine adjustment of the exposure to an optimum value, thus compensating for any variation in the copying sensitivity.

FIG. 7 shows an alternative operating member 30 which is movable between the neutral position N and one other position L. The operating member 30 is pivotally mounted on a stationary pin 31 and is biased by a spring 32 to rotate counterclockwise about the pin 31. In operation, member 30 may be rotated clockwise against the resilience of spring 32 to the position L and stationary stop 33 prevents return rotation beyond neutral position N. In other respects, the arrangement is similar to the embodiment described above.

What is claimed is:

1. An exposure controlling apparatus for an electrophotographic copying machine comprising:

an operating member movable between a first, neutral position and a second position;

means for biasing the operating member toward the first position;

means for locking the operation member at any position intermediate the first and the second position when the operating member is moved from the first toward the second position, said locking means comprising:

a first frictional member on the operating member;

a second frictional member which remains stationary on the copying machine; and ball means for urging the first frictional member into abutting relationship with the second frictional member;

an exposure control means for adjusting the passage of a quantity of exposure radiation to a selected location in the copying machine;

means extending between and connected with the operating member and the exposure control means and responsive to a movement of the operating member for actuating the control means to adjust the quantity of exposure radiation passed to said location; and unlocking means for releasing the locking means.

2. An exposure controlling apparatus according to claim 1 in which the locking means further comprises a hole formed in the operating member; and said ball means comprises:

a ball member for engaging the hole when the operating member assumes the second position; and means for urging the ball member into the hole;

and in which the unlocking means comprises means for releasing the ball member from the action of the urging means upon completion of a copying operation.

3. An exposure controlling apparatus according to claim 1 wherein said unlocking means comprises a solenoid.

4. An exposure controlling apparatus for an electrophotographic copying machine, comprising an operating member movable between a first, neutral position and a second and a third position located respectively on opposite sides of the first position;

means on the operating member for making it operable from the exterior of the copying machine;

means for returning the operating member to the first position;

means for locking the operating member at any position between the second position and the third position against the action of said returning means, said locking means comprising:

a first frictional member on the operating member;

a second frictional member which remains stationary on the copying machine; and means for urging the first frictional member into abutting relationship with said second frictional member;

exposure control means for adjusting the passage of a quantity of exposure radiation to a selected location in the copying machine;

means extending between and connected with the operating member and the exposure control means and responsive to a movement of the operating member for actuating the exposure control means so as to adjust the quantity of exposure radiation passed to said location; and unlocking means for releasing the locking means upon completion of a copying operation, said unlocking means comprising:

means for releasing the urging action of said urging means upon completion of a copying operation.

5. An exposure controlling apparatus according to claim 4 in which the locking means further comprises:

a hole formed in the operating member; and said urging means comprises:

ball means for engaging the hole when the operating member assumes one of said second and third positions; and pivotable means for urging the ball means into the hole; and wherein the unlocking means comprises:

means for pivoting the pivotable urging means out of engagement with said ball means upon completion of a copying operation.

6. An exposure controlling apparatus according to claim 4 wherein said unlocking means comprises a solenoid.

7. An exposure controlling apparatus for an electrophotographic copying machine comprising:

an operating member movable between a first, neutral position and a second position;

means for biasing the operating member toward the first position;

means for locking the operating member at any position intermediate the first and the second position when the operating member is moved from the first toward the second position, said locking means comprising:

a first frictional member on the operating member;

a second stationary frictional member; and ball means for urging the first frictional member into abutting relationship with said second frictional member;

an exposure control means for adjusting the passage of a quantity of exposure radiation to a selected location in the copying machine;

means extending between and connected with the operating member and the exposure control means and responsive to a movement of the operating member for actuating the control means to adjust the quantity of the exposure radiation passed to said location; and unlocking means for releasing the locking means comprising:

means for releasing the urging action of the ball means upon completion of a copying operation.

* * * * *